US006129566A

United States Patent [19]

Davis et al.

[11] Patent Number: 6,129,566

[45] Date of Patent: Oct. 10, 2000

[54] COMPACT CONNECTOR SOCKET ASSEMBLY WITH FIXED LEADS

[75] Inventors: Gerald C. Davis, Hillsborough; John Barile, Apex, both of N.C.

[73] Assignee: Ericsson Inc., Research Triangle Park, N.C.

[21] Appl. No.: 09/160,780

[22] Filed: Sep. 24, 1998

[51] Int. Cl.[7] ..... H01R 13/44

[52] U.S. Cl. ..... 439/131; 361/737; 439/946; 439/676

[58] Field of Search ..... 439/131, 946, 439/676, 344, 55, 329, 372, 686

[56] References Cited

U.S. PATENT DOCUMENTS

| | | | |
|---|---|---|---|
| 5,183,404 | 2/1993 | Aldous et al. | 439/55 |
| 5,336,099 | 8/1994 | Aldous et al. | 439/131 |
| 5,338,210 | 8/1994 | Beckham et al. | 439/131 |
| 5,411,405 | 5/1995 | McDaniels et al. | 439/131 |
| 5,505,633 | 4/1996 | Broadbent | 439/329 |
| 5,634,802 | 6/1997 | Kerklaan | 439/131 |
| 5,637,018 | 6/1997 | Gargiulo | 439/640 |
| 5,667,395 | 9/1997 | Okada et al. | 439/131 |
| 6,005,774 | 12/1999 | Chiba et al. | 361/737 |
| 6,033,240 | 3/2000 | Goff | 439/131 |

*Primary Examiner*—Brian Sircus
*Assistant Examiner*—Michael C. Zarroli
*Attorney, Agent, or Firm*—Coats & Bennett, PLLC

[57] ABSTRACT

A socket assembly for releasably mating with an electrical connector plug utilizes a plurality of fixed leads, and optionally a moveable retainer frame. The fixed leads are in direct electrical communication with an electrical circuit, such as the modem portion of a computing device. At least a portion of each lead remains anchored in a position fixed relative to the electrical circuit and are directly connected to the circuit traces of the electrical circuit. The optional retainer frame is preferably movable between a storage position and a ready position. In the ready position, the retainer frame is adapted to receive and retain the connector plug in a mated position such that the contacts of the connector plug are brought into contact with the fixed leads. In other embodiments, the housing of the electrical circuit includes a socket cavity which is adapted to receive the connector plug. When the connector plug is moved into the mated position by pushing the bottom of the connector plug into the socket cavity, the contacts of the connector plug are brought into contact with the fixed leads.

21 Claims, 7 Drawing Sheets

COMPACT CONNECTOR SOCKET ASSEMBLY WITH FIXED LEADS

FIELD OF THE INVENTION

The present invention relates to the field of electronic connectors and more particularly to a compact connector socket assembly for interfacing with a modular type connector plug, such as those associated with phone lines or network lines.

BACKGROUND OF THE INVENTION

Transmission of data by phone or network cable lines is very popular with users of electronic communications devices such as computers, portable personal digital assistants, and the like. In general, users find that the ability to freely transfer data and information over a telephone line or network cable increases productivity.

Standards have been established for many of the components involved in such transmissions. One important component which has been standardized is connectors. The connectors, typically in conjunction with associated cables, provide electrical interconnection pathways between communications devices and telephone and/or network lines. One popular connector system in the United States is the RJ-11 miniature modular plug connector system. The RJ-11 approach utilizes six pins and is typically used between a telephone line and the telephone itself. The RJ-11 connector system has two main components: an RJ-11 socket (female) and an RJ-11 plug (male).

Typically, transmission of data via phone or network cable lines involves the use of a modem at each end of the transmission. Modems typically reconfigure binary data from a central processing unit and transmit the reconfigured data in analog form through a connector, such as a RJ-11 connector, into the telephone or network line. Increasingly, modems are located within the housing of the electronic communications device. Typically, the socket for the connector is exposed on or through some exterior surface of the housing of the electronic communications device. The most typical arrangement is for the socket to be designed and oriented to accept the corresponding plug almost completely into the housing in a front-first (or "nose-first") orientation that results in the plug and the associated cable extending perpendicularly from the nearby face of the housing.

However, electronic communications devices, and the communications cards associated therewith, are getting smaller and thinner. As such, the size of an RJ-11 or other modular connector socket may exceed the available height restrictions for internal components. Various approaches have been taken to address this problem. One popular approach is that shown in U.S. Pat. No. 5,183,404 to Aldous et al. and its progeny (U.S. Pat. Nos. 5,336,099; 5,338,210; 5,547,401; 5,727,972). The Aldous approach uses a retractable socket having an aperture therein and contact wires, or leads, arrayed along one wall of the aperture. The retractable socket is smaller in height than a "regular" socket and typically engages only a band-shaped portion of the connector plug. Attached to the retractable plug, and providing an indirect electrical path between the leads and the electrical circuit, is a flexible cable (such as a flexible ribbon cable) that is anchored at one end to the device's electronics and moves at the other end with the retractable socket. The electrical signal(s) from the communications cable is communicated through contacts in the plug to the leads, from the leads to the flexible cable, from the flexible cable to the device's electrical circuits. Due to the fact that one end of the flexible cable moves in and out with the retractable socket, the flexible cable undergoes repeated flexing, sometimes leading to failure. In addition, the flexible cable takes up valuable space that could otherwise be used for additional electronics. Thus, while the Aldous approach partially reduces the space required for the socket, still more space reduction is desirable in light of the increasing quantity and complexity of electronics being placed within device housings.

Accordingly, there remains a need for a compact connector socket which requires little space within the housing of the electronic communications device. Such a socket should employ fixed contacts (which may be flexible) which directly connect to the electrical circuits of the electronic communications device without an intervening flexible cable. Further, it is desirable, but not required, that such a socket be available in embodiments that allow for the cable associated with the plug to extend at an angle roughly parallel to the nearby face of the housing.

SUMMARY OF THE INVENTION

The socket assembly of the present invention utilizes a plurality of fixed leads in direct electrical communication with an electrical circuit, such as the modem portion of a cellular phone, to contact the corresponding contacts of the modular connector plug. In some embodiments, a retainer frame is movable between a storage position and a ready position. In the ready position, the retainer frame is adapted to receive and retain the connector plug in a mated position such that the contacts of the connector plug are brought into contact with the fixed leads. In other embodiments, the housing of the electrical circuit includes a socket cavity which is adapted to receive the connector plug. When the connector plug is moved into the mated position by pushing the bottom of the connector plug into the socket cavity, the contacts of the connector plug are brought into contact with the fixed leads. In all embodiments, at least a portion of each lead remains anchored in a position fixed relative to the electrical circuit. Further, the leads are directly connected to the circuit traces of the electrical circuit. By eliminating the flexible cable of the prior art, and instead using fixed leads having a direct connection to the electrical circuit, the present invention allows the flexible cable to be eliminated, thereby improving reliability and saving space and cost.

DETAILED DESCRIPTION

Modular connector plugs 30 for communication cables 32 are well known in the art. Examples include RJ-11 connector plugs, RJ-45 connector plugs, RJ-12 connector plugs, and the like. For purposes of illustration, the sockets and connector plugs described and illustrated herein are of the RJ-11 six-pin type, but it is to be understood that the socket 60 of the present invention can be modified to correspond to any modular type interconnect connector plug 30 such as, for example, RJ-45, RJ-11, or 8-pin modular connector plugs.

Figure 1:
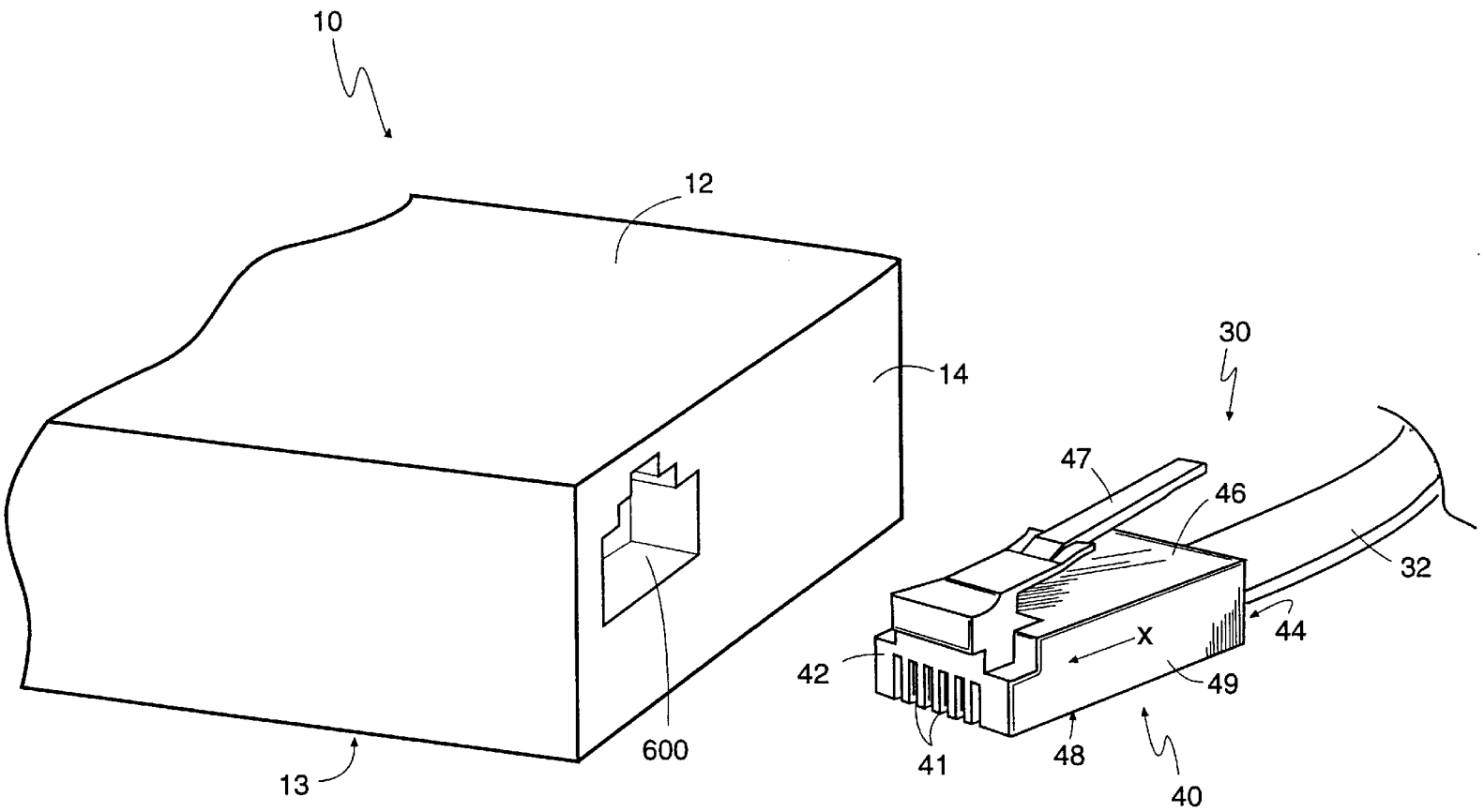
FIG. 1 (Prior Art)
FIG. 1 is a partial perspective view of an electronic communications device, a RJ-11 modular connector plug, and a RJ-11 socket of the prior art.
Figure 7:
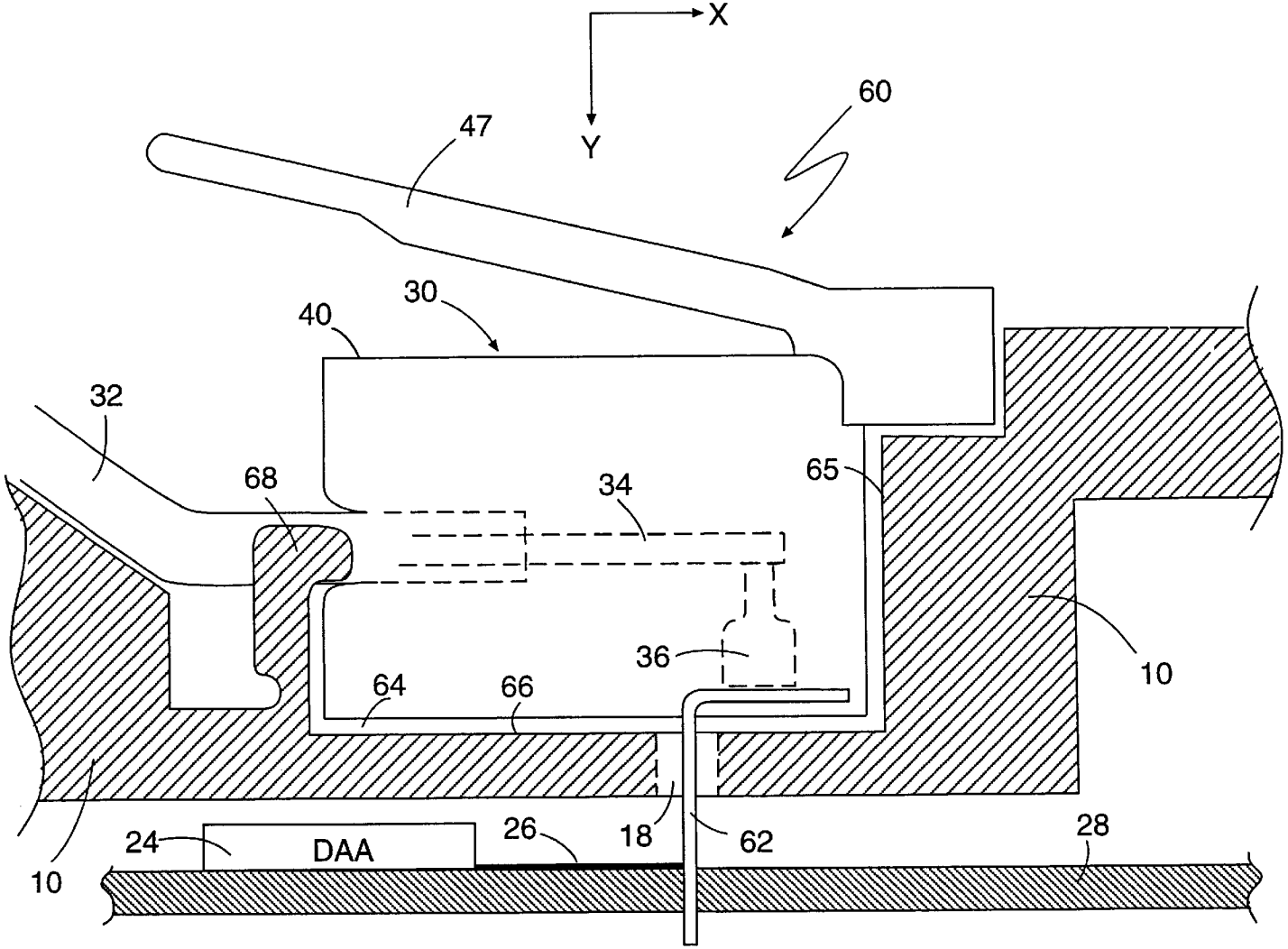
FIG. 7 is a sectional view showing another embodiment of the socket of the present invention with a connector plug in the mated position.

A typical configuration of a RJ-11 connector plug 30 and socket 600 arrangement of the prior art is shown in FIG. 1. Additional detail of the RJ-11 connector plug 30 is shown in FIG. 7. The RJ-11 connector plug 30 is attached to a terminal portion of a cable 32, such as a ribbon cable of a common telephone line, having electrical conductor wires 34 therein. The connector plug 30 includes a main connector block 40 having a front 42, a rear 44, a top 46, a bottom 48, and sides 49. The front 42 typically includes slit-type openings 41 which expose portions of the contacts 36 within the connector block 40. Likewise, the bottom typically includes slittype openings 41 which expose the contacts 36. It is common for the contacts 36 to have L-shaped contact surfaces which extend from the front 42 and across a substantial portion of the bottom 48. Typically there are six contacts 36, most or all of which are electrically connected to corresponding wires 34 in the cable 32 internal to the connector block 40. The sides 49 of the connector block 40 are commonly smooth and relatively parallel. A retention clip 47 is usually integrally attached to the top 46 of the connector block 40.

Figure 2:
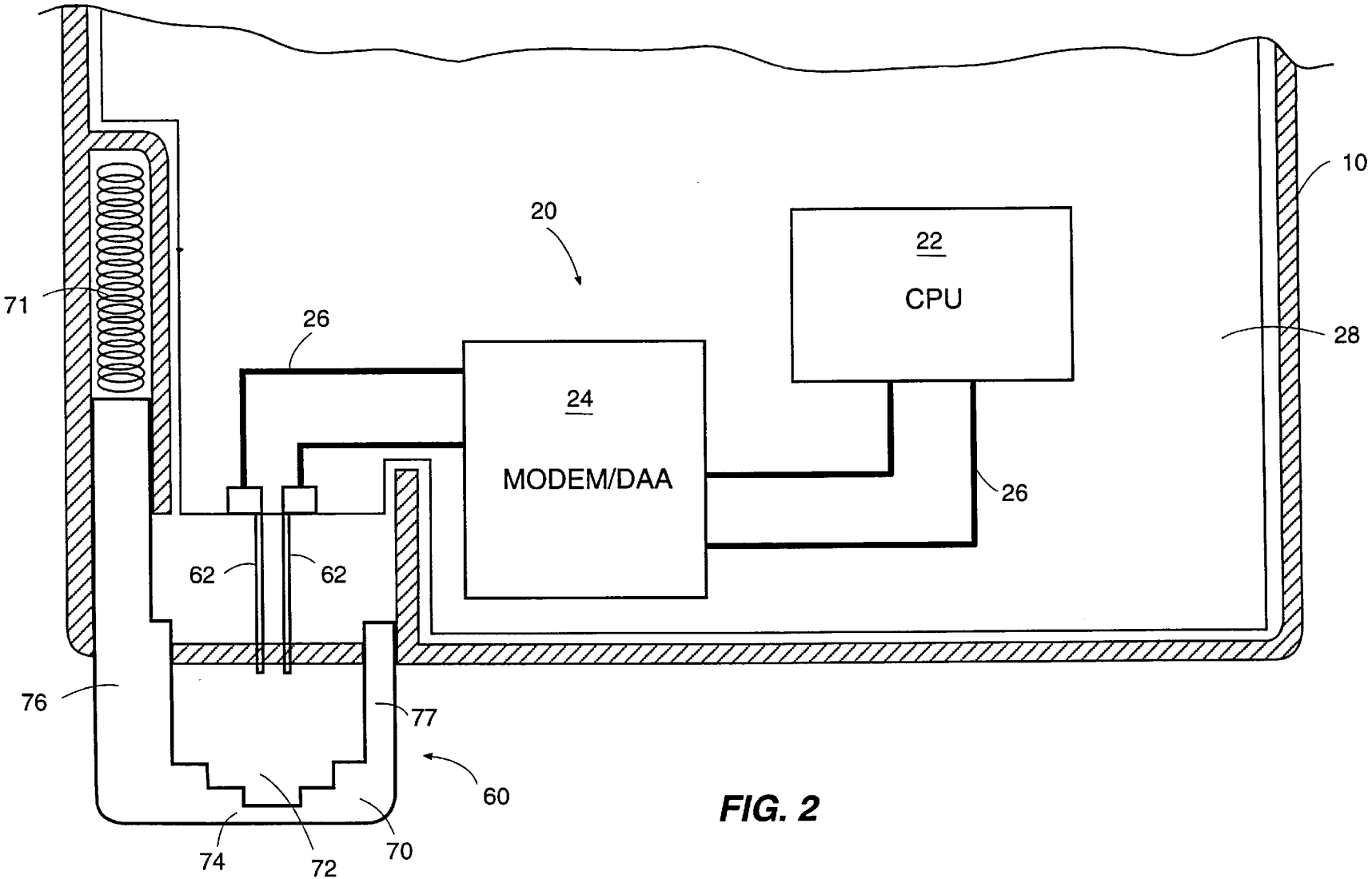
FIG. 2 is a partial cut-away top view of an electronic communications device having one embodiment of the socket of the present invention in the ready position.
Figure 3:
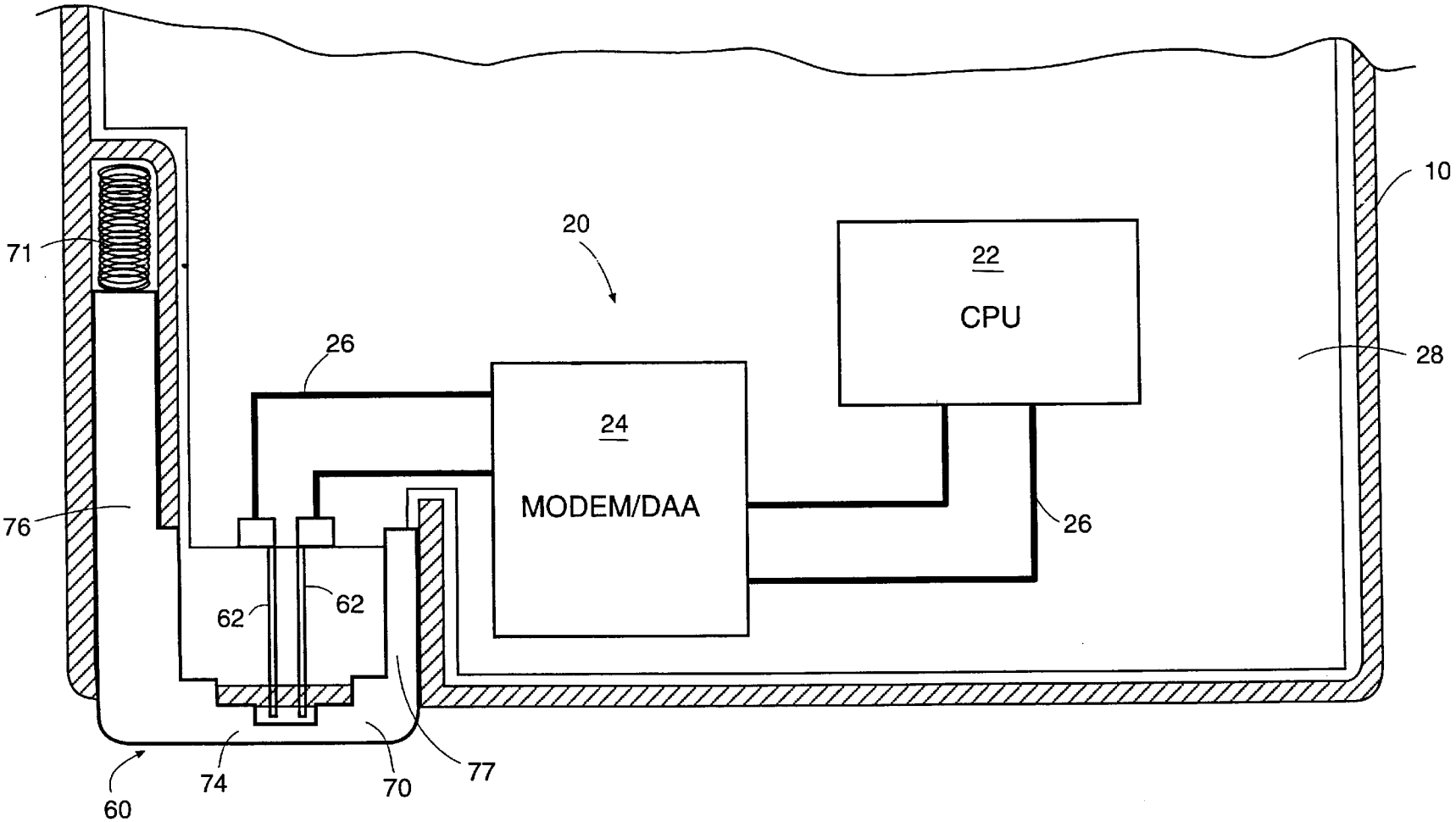
FIG. 3 is a partial cut-away top view of the device of FIG. 2 with the socket in the storage position.

In the prior art, the housing 10 of the electronic communications device, or the communications cards associated therewith, typically included an opening providing access to a socket 600 hardwired to the device's electrical circuits 20. Within the socket 600, leads 62 were positioned so as to come into contact with the contacts 36 of the connector plug 30 when the connector plug 30 was properly inserted, such as along a back wall or along the bottom of the socket 60. The typical insertion orientation of the connector plug 30 was front-, or nose-, first into the socket 600, causing the cable 32 associated with the connector plug 30 to extend nearly perpendicularly from the face of the housing 10. When inserted, the connector plug 30 was substantially surrounded by the socket 600 of the prior art with only a small rearward portion protruding from the nearby face of the housing 10. Referring now to FIGS. 2–3, an electronic communications device is shown with one embodiment of the compact socket 60 of the present invention. For simplicity, a computer will be used as an illustrative example of an electronic communications device. However, the present invention is not limited to computers using the innovative socket 60 claimed herein, but rather encompasses all electronic communications devices using such a socket 60 including without limitation personal digital assistants, communications cards, palmtop computers, telephone handsets, and the like.

The housing 10 of the computer encloses the computer's electrical circuits 20. These electrical circuits 20 typically include at least one central processing unit (CPU) 22, such as common microprocessor, and a Modem/Data Access Arrangement circuit (Modem/DAA) 24 interconnected by circuit traces 26, typically on a printed circuit board 28. The housing 10 also encloses at least a portion of the socket 60.

The socket 60 includes a plurality of fixed leads 62 and a retainer frame 70. The leads 62 are secured on one end to the printed circuit board 28 and extend through an opening in the housing 10 so as to slightly protrude therefrom. The leads 62 may contain various bends, depending on the embodiment, so as to properly position and align the contact surfaces of the leads 62 for mating with the contacts 36 of the connector plug 30. Importantly, the leads 62 are positioned in a fixed relation to the electrical circuits 20. This is not to say that the leads 62 cannot themselves be flexible, in fact flexibility is preferred. Instead, at least one end of the lead should be fixedly mounted in relation to the electrical circuits 20, such as by soldering to the printed circuit board 28. The leads 62 may optionally also be in fixed relation to the housing 10, but such is not required. Because of this fixed relation, the flexible cable interconnecting the leads with the electrical circuits 20 of the prior art can be eliminated, thereby improving reliability and saving space and cost. The leads 62 of the present invention provide a direct electrical path connection between the connector plug 30 and device's electrical circuits 20.

The retainer frame 70 of FIG. 2 is slidably attached to the housing 10. The retainer frame 70 is roughly U-shaped and at least of somewhat less height than the housing 10. The retainer frame 70 includes a cutout 72 defined by a head portion 74 and two legs 76,77. At least one leg 77, and preferably both legs 76,77, slidably engage the housing 10, such as by a tab and channel rail arrangement. At least one leg 76 should engage a spring 71 or other biasing means. The spring 71 urges the retainer frame 70 to move from a storage position (see FIG. 3) to a position ready to receive the connector plug 30 ("ready position", see FIG. 2). Preferably, a push-and-release type releasable catch (not shown) engages a portion of the retainer frame 70 so as to hold the retainer frame 70 in the storage position until released. To minimize damage, it is desirable that the retainer frame 70 have attached thereto a suitable stop means, such as a collapsible L-shaped stirrup or other means like that shown in FIG. 20 of U.S. Pat. No. 5,183,404, for preventing over-insertion of the connector plug 30.

When the user desires to use the socket 60, the user releases the catch holding the retainer frame 70. Acting under the urging of the spring 71, the retainer frame 70 moves to the ready position. Note that when this happens, and in contrast to prior art approaches, the leads 62 do not move with the retainer frame 70 but rather stay in a fixed location. In the ready position, the cutout 72 in combination with a portion of the wall of the housing 10, such as the rear face 14, defines a passage suitable for insertion of the connector plug 30. The connector plug 30 is inserted nose-first into the cutout 72 of the retainer frame 70. For simplicity of description, a direction called "X" is defined herein as being the direction from the rear 44 of the connector block 40 to the front 42 of the connector block 40. Thus, the connector plug 30 is inserted into the retainer frame 70 of the socket 60 in the X direction. With the connector plug 30 in the inserted position, the retainer frame 70 mechanically engages the connector block 40, and optionally the retention clip 47, of the connector plug 30 so as to discourage displacement thereof. In addition, the contacts 36 of the connector plug 30 are in physical and electrical contact with the leads 62 such that electrical signals can be freely communicated between the electrical circuit 20 and the connector plug 30, and hence the cable 32.

Because the retainer frame 70 is typically thinner than the front 42 to rear 44 length of the connector plug 30 (i.e., in the X direction), the connector plug 30 typically extends both above and below the retainer frame 70. In this position, the cable 32 associated with the connector plug 30 extends roughly vertically up from the plane of the retainer frame 70.

In some alternative embodiments, the cutout 72 of the retainer frame 70 need not be perpendicular to the plane defined by the head portion 74 and the two legs 76,77 (referred to as the "retainer plane"). That is, the cutout 72 may also be at an tilted angle with respect to the retainer plane. However, such an arrangement is not believed to be as compact as a perpendicular arrangement.

Figure 4:
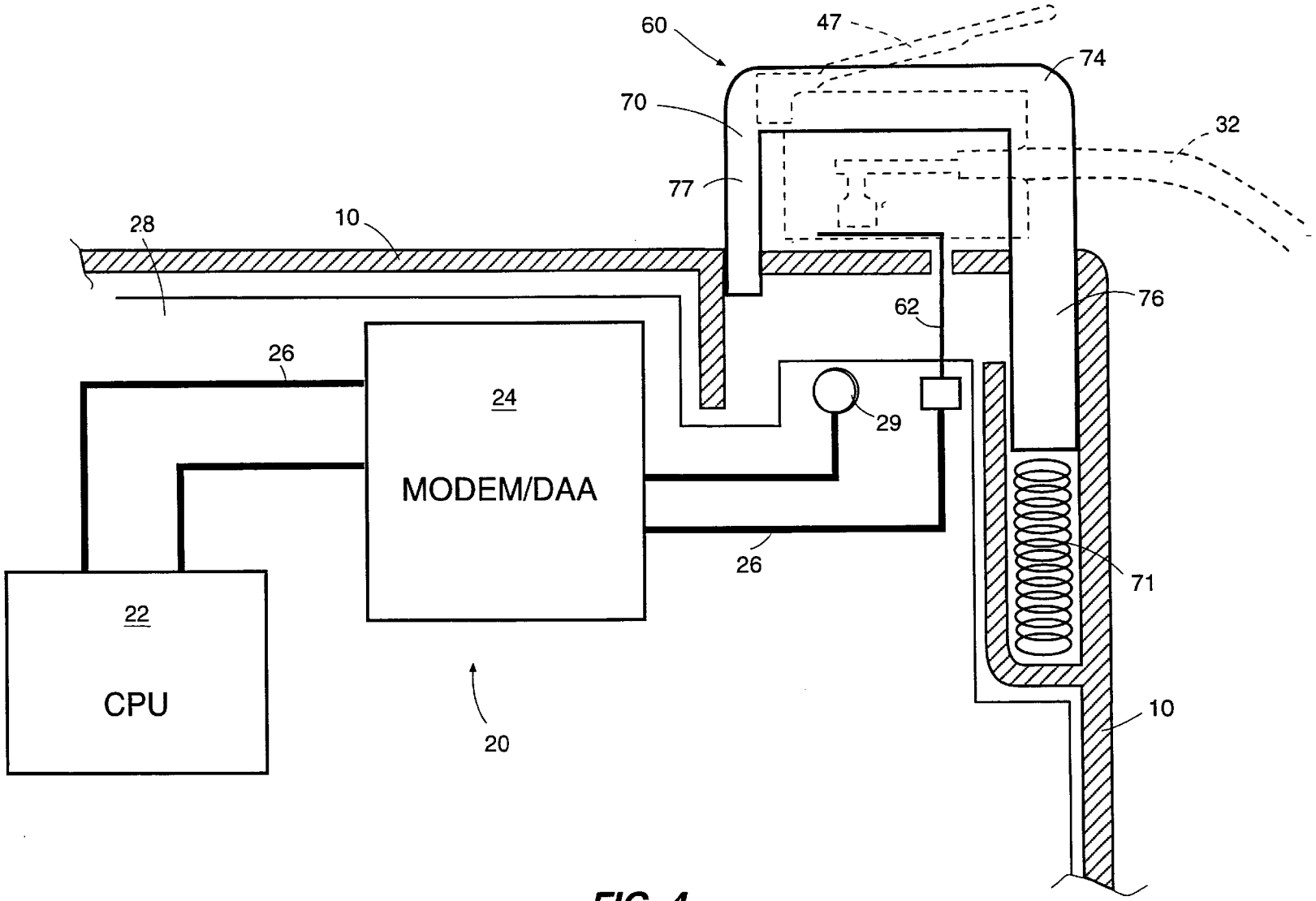
FIG. 4 is a partial cut-away top view of an electronic communications device having another embodiment of the socket of the present invention in the ready position and a plug and associated cable shown in phantom lines.
Figure 5:
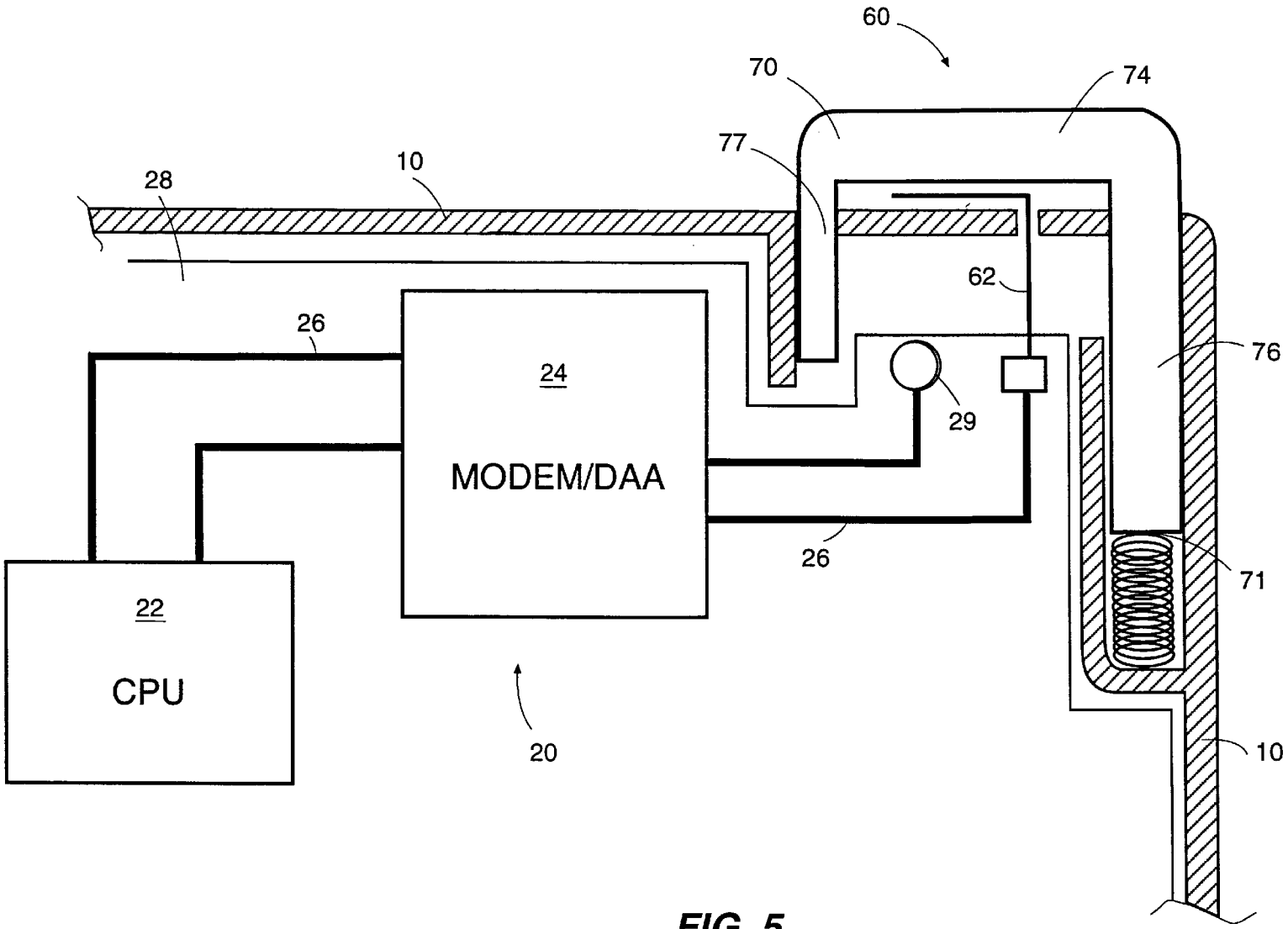
FIG. 5 is a partial cut-away top view of the device of FIG. 4 with the socket in the storage position and no plug or associated cable.

Another embodiment of the socket 60 shown in the ready position in FIG. 4 and the storage position in FIG. 5. While only one lead 62 is readily apparent in FIG. 4, this embodiment includes at least two leads 62 which are vertically aligned and directly attached to opposite sides of the printed circuit board 28. Accordingly, a passthrough hole 29 or equivalent is typically required for the trace 26 associated with the lead 62 on the side of the printed circuit board 28 opposite the Modem/DAA 24. While only one retainer frame 70 may function acceptably, preferably there are two retainer frames 70 in this embodiment which act in concert so as to releasably capture the connector block 40 therebetween. The retainer frames 70 should have an embossment or other means associated with the inside of the head portion 74 to engage the connector block 40 and discourage displacement thereof. As with the FIGS. 2–3 embodiment, the retainer frame 70 is slidably attached to the housing 10 and preferably biased towards the ready position by a spring 71.

This embodiment of FIGS. 4–5 principally differs from that previously described in relation to FIGS. 2–3 in that, instead of the X direction of the connector plug 30 being perpendicular to the retainer plane, the X direction of the connector plug 30 is parallel to the retainer plane. Further, as shown in phantom lines in FIG. 4, the cable 32 associated with the connector plug 30 runs parallel to the face of the housing 10 nearest the retainer frame 70.

Figure 6:
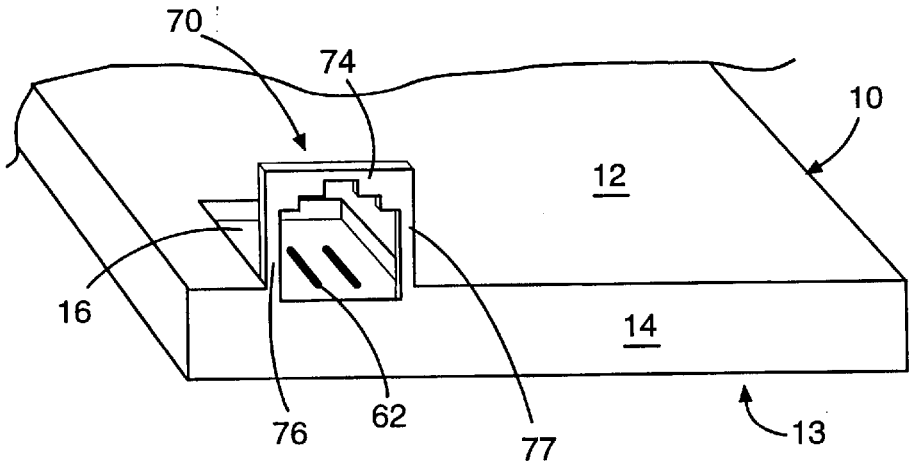
FIG. 6 shows perspective views of two additional embodiments of the socket of the present invention in the ready position.
Figure 6:
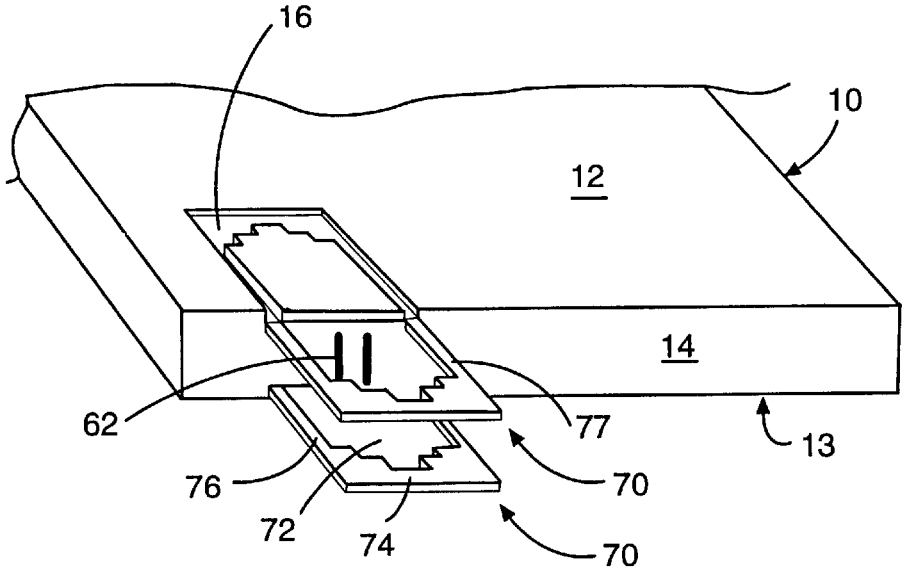

As an alternative to a spring 71 loaded retainer frame 70 that is substantially retracted in the storage position, the retainer frame 70 (or retainer frames 70) may alternately be hingably attached to the housing 10 as shown in FIG. 6. The embodiment shown in FIG. 6(*a*) includes a single retainer frame 70 whose legs 76,77 are hingably attached to the top face 12 of the housing 10. The retainer frame 70 is designed to rotate approximately 90° from the storage position to the ready position. The retainer frame 70 preferably fits into a well 16 and lies flush with the top face 12 of the housing 10 in the storage position. It should be noted that the back wall of the well 16 may advantageously be used as a stop to prevent over-insertion of the connector plug 30. The contact surface of the leads 62 in this embodiment are roughly parallel to the top face 12 and perpendicular to the rear face 14 of the housing 10. In this embodiment, the connector plug 30 is inserted into the retainer frame 70 nose-first and protrudes forwardly from the retainer plane.

Another embodiment of the socket 60 is shown in FIG. 6(*b*). This embodiment includes two retainer frames 70 whose legs 76,77 are hingably attached to the top face 12 and bottom face 13 of the housing 10. The retainer frames 70 are designed to rotate approximately 180° from the storage position to the ready position. The retainer frames 70 preferably fit into wells 16 and lie flush with the respective faces 12,13 of the housing 10 in the storage position and preferably are releasably held in the storage position by snaps, detents, or the like. The contact surface of the leads 62 in this embodiment are roughly parallel to the rear face 14 and perpendicular to the top face 12 of the housing 10. In this embodiment, the connector plug 30 is inserted into the retainer frames 70 nose-first and the retainer planes are roughly perpendicular to the sides of the connector block 40.

If desired, the leads 62 of FIG. 6 may be protected during non-use by a removable cover (not shown).

The discussion above has focused on sockets 60 having a plurality of fixed leads 62 and a retainer frame 70 which is moveable between a first position for receiving the connector plug 30 and a second position for storage. The purpose of such a retainer frame 70 is to engage the connector plug 30 and discourage the displacement thereof so that the contacts 36 of the connector plug 30 remain in contact with the leads 62 during use. However, such a retainer frame 70 is not required in all cases. Referring to FIG. 7, another embodiment of the socket 60 is shown which does not include such a retainer frame 70. Instead, the socket 60 includes a plurality of fixed leads 62 and a socket cavity 64. As with the leads 62 described above, the leads 62 directly connect to the electrical circuits 20 of the device. One end of each lead 62 directly connects to the electrical circuits 20 of the device and the other end extends up into the socket cavity 64 via a hole 18 in the housing 10. The socket cavity 64 includes a front wall 65, a bottom wall 66, and at least one mechanical catch 68. The front wall 65 and the bottom wall 66 help define the socket cavity 64 and abut the front 42 and bottom 48 respectively of the connector block 40 when the connector plug 30 is in the mated position as shown in FIG. 7. The mechanical catch 68 engages the rear 44 of the connector plug 30 so as to discourage the displacement of the connector plug 30. Preferably, there are two catches 68, one disposed on each side of the cable 32 when the connector plug 30 is in the mated position. The catches 68 may be of any suitable type, such as a substantially vertical flexible shaft having a rounded boss on the upper end thereof as shown in FIG. 7.

The connector plug 30 is inserted into the socket cavity 64 bottom-first. For clarity, the direction from the top 46 of the connector plug 30 to the bottom 48 of the connector plug 30 will be referred to as the "Y" direction. Thus, the connector plug 30 is inserted into the socket cavity 64 by being moved primarily in the Y direction. As the connector plug 30 is being pushed down, the catch 68 is displaced out of the way and springs back into position when the connector plug 30 reaches the mated position. As with the other embodiments described above, the leads 62 are in contact with the contacts 36 of the connector plug 30 when the connector plug 30 is in the mated position.

For the embodiment shown in FIG. 7, the retention clip 47, and preferably the top 46 of the connector block 40, protrude out from the face of the housing 10 nearest the socket 60 so as to facilitate removal of the connector plug 30. In addition, the cable 32 associated with the connector plug 30 should run roughly parallel to the nearby face of the housing 10 for at least small distance. It may be desirable for a short portion of the housing 10 opposite the front 42 wall of the socket cavity 64 to be angled toward the bottom wall of the socket cavity 64 so as to allow the cable 32 some space to bend. In addition, it may be desirable to protect the socket cavity 64 and leads 62 when not in use by a removable cover (not shown).

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A socket assembly for releasably mating with an electrical connector plug, said connector plug having a plurality of contacts and having a front, a rear, sides, and a bottom, the direction from said rear to said front defining a longitudinal direction, the direction from one of said sides to the other of said sides defining a lateral direction, comprising:

a) an electrical circuit;

b) a plurality of leads having first and second end portions, said first end portions affixed at respective fixed locations with respect to said electrical circuit; said leads directly connected to said electrical circuit at said first end portions; and c) a retainer frame; said retainer frame moveable between a first position for storage and a second position for receiving said connector plug into a mated position;

d) wherein said retainer frame is adapted to receive and retain said connector plug, when said retainer frame is in said second position, such that said leads contact corresponding contacts of the connector plug.

2. The socket assembly of claim 1 wherein said retainer frame is slidably moveable between said first position and said second position.

3. The socket assembly of claim 1 wherein said retainer frame is rotatable between said first position and said second position.

4. The socket assembly of claim 3 wherein said retainer frame is rotatable about a generally horizontal hinge between said first position and said second position.

5. The socket assembly of claim 1 wherein said retainer frame includes an aperture therethrough and wherein said connector plug longitudinally extends into said aperture and longitudinally protrudes from said retainer frame.

6. The socket assembly of claim 1 wherein said retainer frame includes an aperture therethrough and wherein said connector plug laterally extends into said aperture.

7. The socket assembly of claim 1 including a plurality of retainer frames, said retainer frames independently moveable between respective first positions for storage and respective second positions for receiving and retaining said connector plug.

8. The socket assembly of claim 1 wherein said leads contact said contacts of said connector plug along said front.

9. The socket assembly of claim 1 wherein said leads contact said contacts of said connector plug along said bottom.

10. The socket assembly of claim 1 wherein said retainer frame is generally U-shaped.

11. The socket assembly of claim 1 wherein said retainer frame defines a socket plane and wherein said socket plane is generally perpendicular to said longitudinal direction when said retainer frame is in said second position.

12. The socket assembly of claim 1 wherein said retainer frame defines a socket plane and wherein said socket plane is generally parallel to said longitudinal direction when said retainer frame is in said second position.

13. The socket assembly of claim 1 wherein said retainer frame is adapted to receive and retain an RJ-11 connector plug, when said retainer frame is in said second position, such that said leads contact corresponding contacts of the RJ-11 connector plug.

14. The socket assembly of claim 1 wherein:

a) said retainer frame is slidably moveable between said first position and said second position;

b) said retainer frame includes an aperture therethrough; and c) when said retainer frame is in said second position and the connector plug is in said mated position:

i) said connector plug longitudinally extends into said aperture and longitudinally protrudes from said retainer frame;

ii) said retainer frame defines a socket plane and wherein said socket plane is generally perpendicular to said longitudinal direction; and iii) said leads contact said contacts of said connector plug along said bottom.

15. The socket assembly of claim 1 wherein:

a) said retainer frame is slidably moveable between said first position and said second position;

b) said retainer frame includes an aperture therethrough; and c) when said retainer frame is in said second position and the connector plug is in said mated position:

i) said connector plug laterally extends into said aperture;

ii) said retainer frame defines a socket plane and wherein said socket plane is generally parallel to said longitudinal direction; and iii) said leads contact said contacts of said connector plug along said bottom.

16. The socket assembly of claim 1 wherein:

a) said retainer frame is rotatable about a generally horizontal hinge between said first position and said second position;

b) said retainer frame includes an aperture therethrough; and c) when said retainer frame is in said second position and the connector plug is in said mated position:

i) said connector plug longitudinally extends into said aperture and longitudinally protrudes from said retainer frame;

ii) said retainer frame defines a socket plane and wherein said socket plane is generally perpendicular to said longitudinal direction; and iii) said leads contact said contacts of said connector plug along said bottom.

17. The socket assembly of claim 1 including a plurality of retainer frames, said retainer frames independently moveable between respective first positions for receiving and retaining said connector plug and respective second positions for storage and wherein:

a) said retainer frames are rotatable about respective horizontal hinges between said first position and said second position;

b) said retainer frames include apertures therethrough; and c) when said retainer frames are in said second position and the connector plug is in said mated position:

i) said connector plug laterally extends into said apertures;

ii) said retainer frames define a plurality of socket planes and wherein said socket planes are generally parallel to said longitudinal direction; and iii) said leads contact said contacts of said connector plug along said bottom.

18. A socket assembly for releasably mating with an electrical connector plug having a plurality of contacts and having a top, a bottom, a front, a rear, and sides, the direction from said top to said bottom defining a Y direction, comprising:

an electrical circuit disposed on a printed circuit board;

a plurality of leads having first and second end portions, said first end portions of said leads affixed to respective fixed locations with respect to said electrical circuit; said leads directly connected to said electrical circuit proximate said first end portions;

a housing having an socket cavity therein; said socket cavity aligned with said leads;

a mechanical catch associated with said housing;

wherein said socket cavity is adapted to receive and retain the connector plug inserted thereinto bottom-first in the Y direction to a mated position;

wherein, with the connector plug in said mated position, said leads directly contact corresponding contacts of the connector plug and said catch engages said rear of the connector plug and said top protrudes from said socket cavity in a direction opposite said Y direction.

19. The socket assembly of claim 18 wherein said socket cavity includes a front wall and a bottom wall and, with said connector plug in said mated position, said front wall engages said front and said bottom wall engages said bottom and said top is external to said housing.

20. The socket assembly of claim 19 wherein said bottom wall includes a hole and at least one of said leads extends through said hole.

21. The socket assembly of claim 18 wherein said socket cavity is adapted to receive an RJ-11 connector plug inserted thereinto bottom-first to a mated position and wherein, with the RJ-11 connector plug in said mated position, said leads contact corresponding contacts of the RJ-11 connector plug and said catch engages said rear of said RJ-11 connector plug and said top protrudes from said socket cavity in a direction opposite said Y direction.

* * * * *